US005813182A

United States Patent [19]

Commins

[11] Patent Number: 5,813,182

[45] Date of Patent: Sep. 29, 1998

[54] STRAP TIE CONNECTOR

[75] Inventor: Alfred D. Commins, Danville, Calif.

[73] Assignee: Simpson Strong-Tie Company, Inc., Pleasanton, Calif.

[21] Appl. No.: 740,020

[22] Filed: Oct. 23, 1996

[51] Int. Cl.[6] ..... E02D 27/00

[52] U.S. Cl. ..... 52/295; 52/712; 52/715

[58] Field of Search ..... 52/295, 370, 712, 52/713, 714, 715, 699, 293, 294, 296; 264/274

[56] References Cited

U.S. PATENT DOCUMENTS

| | | |
|---|---|---|
| 589,079 | 8/1897 | Glazier . |
| 887,217 | 5/1908 | Oliphant . |
| 953,060 | 3/1910 | Ross . |
| 1,741,776 | 12/1929 | Isaacson . |
| 1,848,422 | 3/1932 | Isaacson . |
| 1,909,984 | 5/1933 | Prindle . |
| 2,920,477 | 1/1960 | Shaw . |
| 3,750,360 | 8/1973 | Kingston . |
| 3,889,441 | 6/1975 | Fortine . |
| 3,998,026 | 12/1976 | Allen . |
| 4,096,677 | 6/1978 | Gilb . |
| 4,202,149 | 5/1980 | Betrue, Sr. . |
| 4,404,781 | 9/1983 | Gilb . |
| 4,413,456 | 11/1983 | Gilb . |
| 4,570,403 | 2/1986 | Dannemiller . |
| 4,739,598 | 4/1988 | Jensen et al. . |
| 4,924,648 | 5/1990 | Gilb et al. . |
| 5,150,553 | 9/1992 | Commins et al. . |
| 5,390,455 | 2/1995 | Antolini ..... 52/295 X |
| 5,595,031 | 1/1997 | Commins ..... 52/295 X |

*Primary Examiner*—Creighton Smith
*Attorney, Agent, or Firm*—James R. Cypher

[57] ABSTRACT

A connector for securing a structural member to a concrete foundation. The connector is embedded in a concrete foundation and fasteners attach the connector to the structural member to be anchored. A connector constructed in accordance with the present invention consists of a foot section having a proximal portion, a distal portion, substantially planar lateral side portions and curled lateral side edges, the curled side edges being curled away from the planar lateral side portions along a substantial portion of the length of the foot section to aid the flow of uncured concrete around the foot section of the connector.

39 Claims, 4 Drawing Sheets

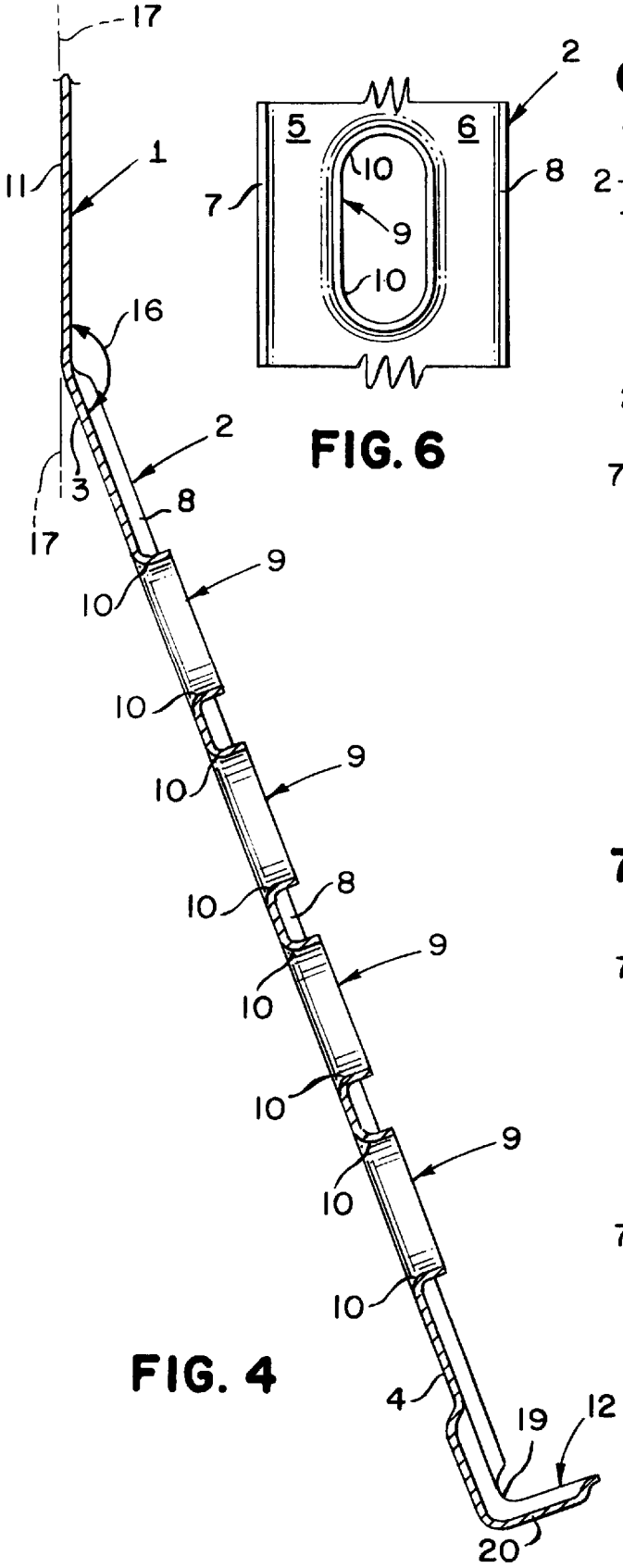
FIG. 4
FIG. 6
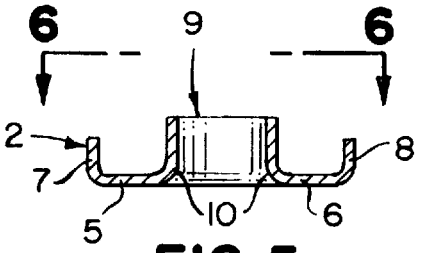
FIG. 5
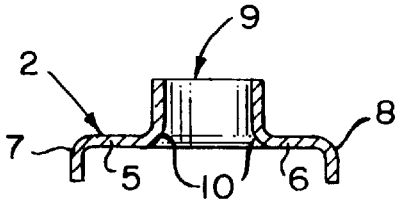
FIG. 5A
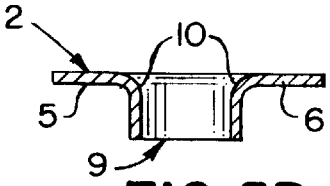
FIG. 5B
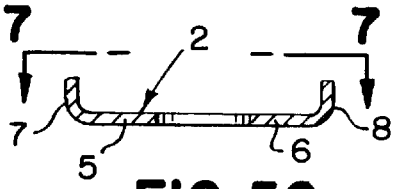
FIG. 5C
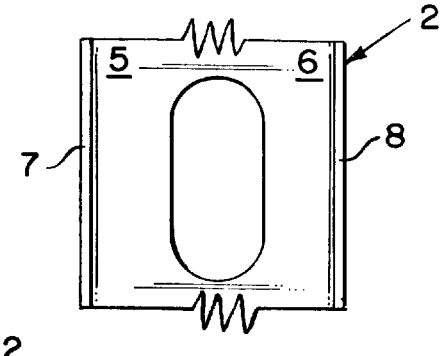
FIG. 7

STRAP TIE CONNECTOR

BACKGROUND

This invention relates to a connector for securing a structural member to a concrete foundation. The connector is embedded in a concrete foundation and fasteners attach the connector to the structural member to be anchored.

Earthquakes, hurricanes, tornadoes, and floods impose forces on a building that can cause structural failure. To counteract these forces, it has become common practice to strengthen or add ties between the structural members of a building in areas where such cataclysmic forces can occur.

One of the most critical connections that should be made is between the support walls of a building and its foundation. In such an application, the connector or anchoring member embedded in the concrete foundation will often be placed near the side surface of the foundation. This is because the support walls of buildings are often built at the edges of the foundation. When an embedded anchor or connector is located near the side surface of a foundation, it is important that the concrete form a continuous member between the connector and the side surface to protect the connector from the elements and to maximize the concrete's hold on the embedded connector.

Forming a continuous member around the embedded connector is of particular concern to builders who use strap anchor connectors to anchor a shear wall to a narrow stem wall foundation, because strap anchor connectors are generally placed extremely close to the side surface of the foundation. Strap anchor connectors are designed to run along the outside of the shear wall, rather than through it as connectors that use anchor bolts do. Because shear walls are generally located with their outer side surface generally in line with the outer side surface of the stem wall foundation, the strap anchor connector, ideally, should protrude from the foundation at the interface of the outer side surface and upper surface of the foundation. Note that the strap anchor connector will normally be bent to direct the bottom of the embedded portion into the center of the stem wall as much as possible, but the upper portion of the embedded strap anchor connector remains very close to the outer surface of the foundation. This proximity of the upper portion of the embedded strap anchor connector to the outer side surface of the concrete foundation is problematic for builders.

Often, during the pouring of the concrete foundation, this tight space between the form board which defines the outer surface of the concrete foundation and the top of the embedded portion of the strap anchor connector will not be filled with concrete due to the inability of the uncured concrete to flow past the wide strap portion and into the narrow space. Furthermore, the builder pouring the foundation will not be aware of the discontinuity in the concrete member because it is hidden from view by the strap anchor and the form board. Thus there is a need in the field for a connector with an improved embedded anchoring portion that aids the flow of concrete around it to confined spaces which the uncured concrete has trouble reaching.

SUMMARY OF THE INVENTION

An object of the present invention is to provide an improvement to connectors having embedded planar foot portions that aides the flow of concrete around the foot portion.

A further object of the present invention is to provide an improvement to connectors having embedded planar foot portions that aides the flow of concrete around the foot portion while maintaining the structural integrity of the embedded foot portion so that it will not tear or bend more easily under tension loads.

A further object of the present invention is to maximize the bonding of the concrete around the foot portion of the connector while maintaining the structural integrity of the embedded foot portion so that it will not tear or bend more easily under tension loads.

A further object of the present invention is to increase the rigidity of the embedded foot portion of the connector.

These and other objects of the present invention will become apparent, with reference to the drawings, the description of the preferred embodiment and the claims.

DESCRIPTION OF THE DRAWINGS

FIG. 4 is a cross sectional view of a section of the connector of FIG. 3 taken along line 4—4 of FIG. 3.

FIG. 5 is a cross sectional view of the foot portion of the connector of FIG. 3 taken along line 5—5 of FIG. 3.

FIG. 5A is a cross sectional view of the foot section of a connector formed in accordance with the present invention. The alternate form shown has the curled side edges of the drawn opening projected in the opposite direction to the curled side edges of the foot section.

FIG. 5B is a cross sectional view of the foot section of a connector formed in accordance with the present invention. The alternate form shown has a drawn opening, but the side edges of the foot section are not curled.

FIG. 5C is a cross sectional view of the foot section of a connector formed in accordance with the present invention. The alternate form shows the foot section having curled side edges and an opening without curled side edges.

FIG. 6 is an elevated front view of a portion of the foot section of the connector of FIG. 5 taken along line 6—6.

FIG. 7 is an elevated front view of a portion of the foot section of the connector of FIG. 5C taken along line 7—7.

DESCRIPTION OF THE PREFERRED EMBODIMENT

Figure 1:
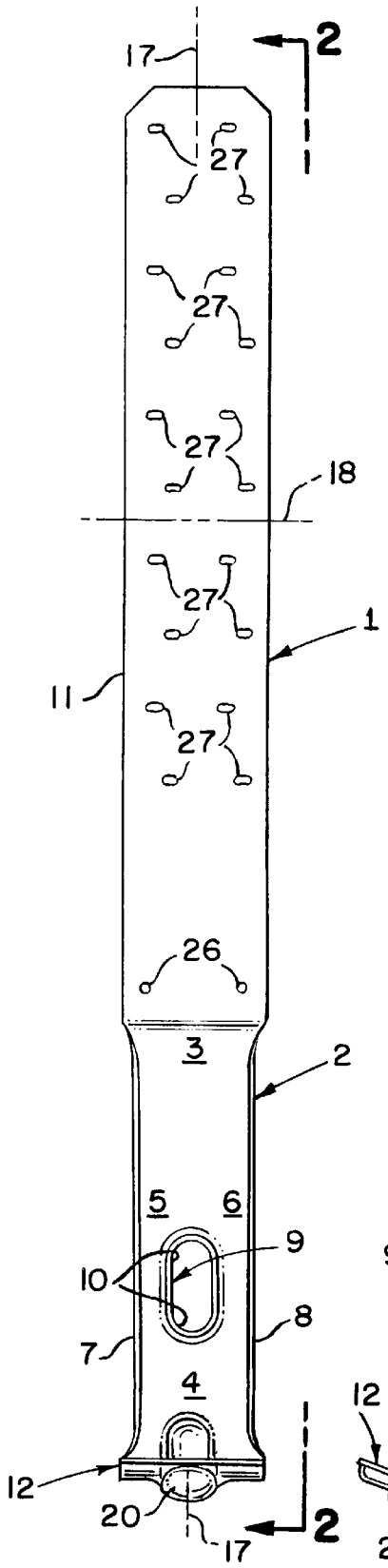
FIG. 1 is a front elevation view of a connector formed in accordance with the present invention.

Referring to FIG. 1, a connector 1 constructed in accordance with the present invention consists of a foot section 2 having a proximal portion 3, a distal portion 4, substantially planar lateral side portions 5 and 6 and curled lateral side edges 7 and 8, the curled side edges 7 and 8 being curled away from the planar lateral side portions 5 and 6 along a substantial portion of the length of the foot section 2 to aid the flow of uncured concrete around the foot section 2 of the connector 1. As seen in FIG. 5, the curled side edges 7 and 8 can be curled through approximately 90 degrees, but any curling of the curled side edges 7 and 8 away from the planar lateral side portions 5 and 6 is considered to be within the scope of the present invention.

Referring to FIG. 1, a connector 1 constructed in accordance with the present invention can also consist of a foot section 2 having a proximal portion 3, a distal portion 4 and a drawn opening 9. The curled edges 10 of the drawn opening 9 aid the flow of uncured concrete around the foot section 2. The drawn opening 9 is formed by making a slit in the material of the foot section 2 and then stretching and curling the material away from the foot section 2 to enlarge the slit into a drawn opening 9. The drawn opening 9 can be any shape and still be considered within the scope of the invention.

As seen in FIG. 1, the preferred embodiment of the connector 1 constructed in accordance with the present invention combines both curled side edges 7 and 8 and a drawn opening 9.

As seen in FIG. 1, a connector 1 formed in accordance with the present invention will include an attachment section 11 integrally connected to the proximal portion 3 of the foot section 2, and a hook section 12 integrally connected to the distal portion 4 of the foot section 2. The hook section 12 and the foot section 2 form a mechanical interlock with the concrete structural member 13.

Figure 8:
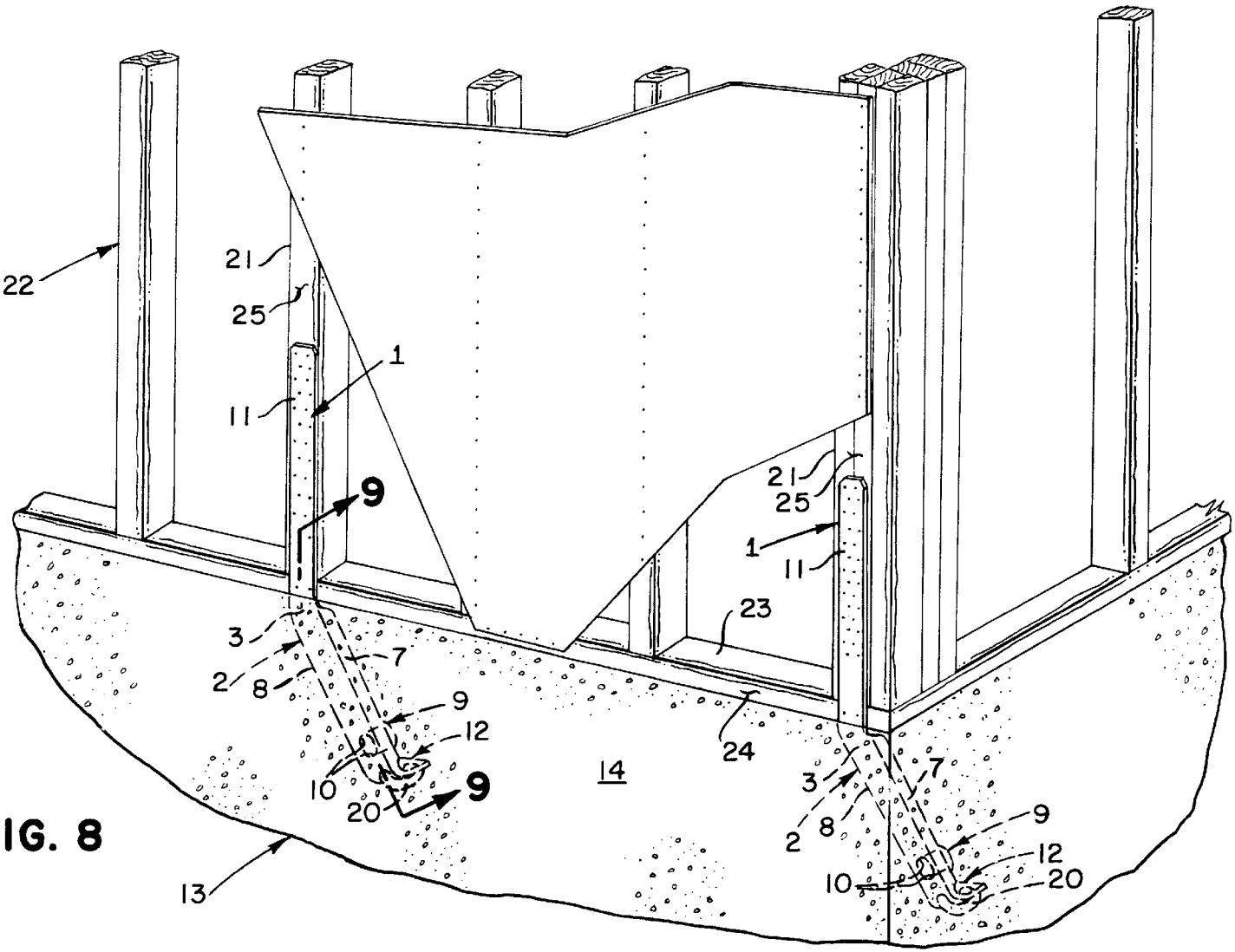
FIG. 8 is a perspective view of a connection between a framed wall and a concrete foundation using two connectors formed in accordance with the present invention. The connectors shown are the preferred form of the invention for joining the vertical frame members of a framed wall to the stem wall foundation on which the framed wall sits. The framed wall is shown having a mudsill, vertical frame members and plywood sheathing as would be present in a wall designed to resist lateral shear loads. The connector is shown both near a corner in the concrete foundation and away from any corners in the concrete foundation. Only a portion of the framed wall and its foundation is shown. Dashed lines show the foot section of the connector embedded in concrete foundation.

As seen in FIG. 8, a connector 1 formed in accordance with the present invention is particularly designed to be used in installations where the attachment section 11 protrudes near the interface of the side surface 14 and the upper surface 15 of the concrete structural member 13. For such installations the foot section 2 of the connector 1 should be disposed at a selected obtuse angle 16 to the attachment section 11, so that the hook section 12 is placed at a position in the concrete structural member 13 where the concrete surrounding it is maximized. This can best be seen in FIG. 10. This selected obtuse angle 16 depends on the dimensions of the concrete structural member 13 and the dimension of the foot section 2 and the hook section 12 of the connector 1.

As seen in FIG. 5 and FIG. 5A, the curled side edges 7 and 8 of the foot section 2 may be displaced away from the planar lateral side portions 5 and 6 in any direction and still remain within the scope of the present invention. Similarly, as seen in FIG. 5A and FIG. 5B the curled edges 10 of the drawn opening 9 may be formed away from the foot section 2 in any direction and still remain within the scope of the present invention.

The direction and amount of curling of the curled side edges 7 and 8 and the curled edges 10 of the drawn opening 9 primarily depends on the form of concrete structural member 13 and where and how the foot section 2 is placed in the concrete structural member 13.

Also, any displacement or curling of the foot section 2 of the connector 1 generally needs to be undone before the transition to the attachment section 11. This is because the attachment section 11 should normally be a thin planar member where it runs along the outside of the framed wall 22 so as to interfere minimally with attachment of members to the outside of the framed wall 22. This is best shown in FIG. 8. Thus the more the curled side edges 7 and 8 are curled at the foot portion 2, the more they must be uncurled and stretched before reaching the attachment section 11, which can weaken the connector 1.

Also, forming the drawn opening 9 and the curled side edges 7 and 8 means more work must be done on the connector 1 which adds to its expense. For these reasons, the curled side edges 7 and 8 and the curled edges 10 of the drawn opening 9 need only be displaced the necessary amount to achieve sufficient concrete flow around the foot section 2 in a given installation.

Figure 9:
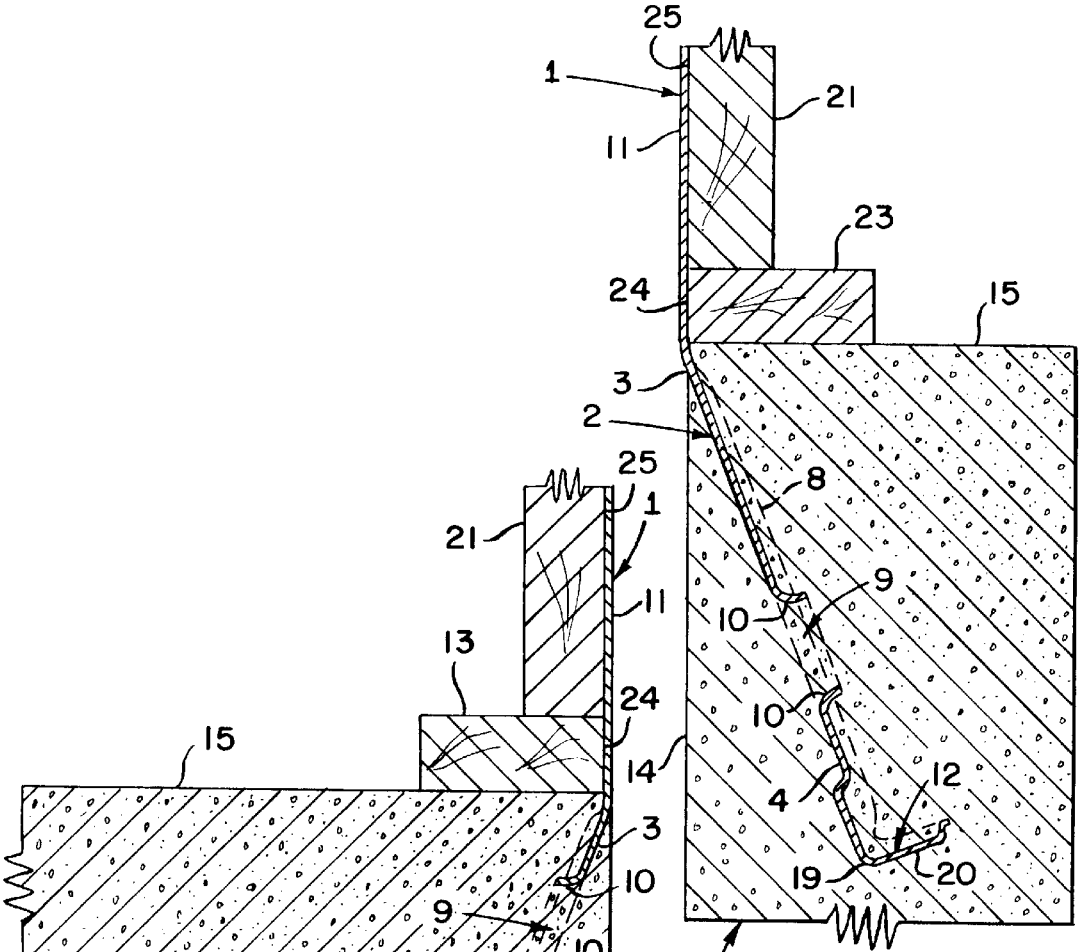
FIG. 9 is a cross sectional view of a portion of the connector of FIG. 8 embedded in a single-pour concrete foundation taken along line 9—9 of FIG. 8.
Figure 10:
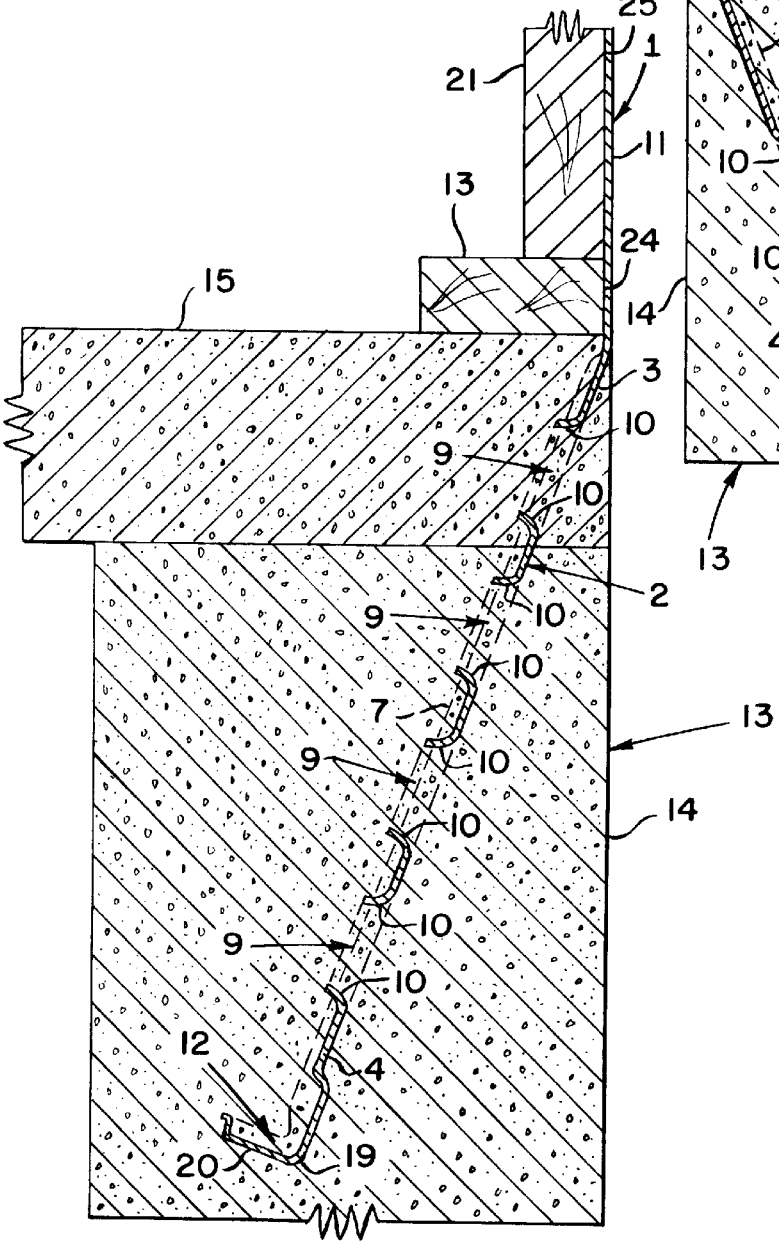
FIG. 10 is a cross sectional view of a portion of the connector of FIG. 3 embedded in a double-pour concrete foundation and ready for attachment to a vertical frame member resting on top of a mudsill.

As seen in FIG. 9 and FIG. 10, in installations where the attachment section 11 protrudes near the interface of the side surface 14 and the upper surface 15 of the concrete structural member 13, it is important to aid flow of uncured concrete to the space between the foot section 2 and the side surface 14 of the concrete structural member 13. This is a narrow space where concrete has difficulty reaching. Furthermore, the foot section 2 prevents the builder from seeing this space, so he would not know to push more uncured concrete into the space to fill any holes. Thus in such installations, the curled side edges 7 and 8 and curled edges 10 of the drawn opening 9 are preferably curled away from the side surface 14 of the concrete structural member 13 to aid the flow of uncured concrete to this space.

Figure 2:
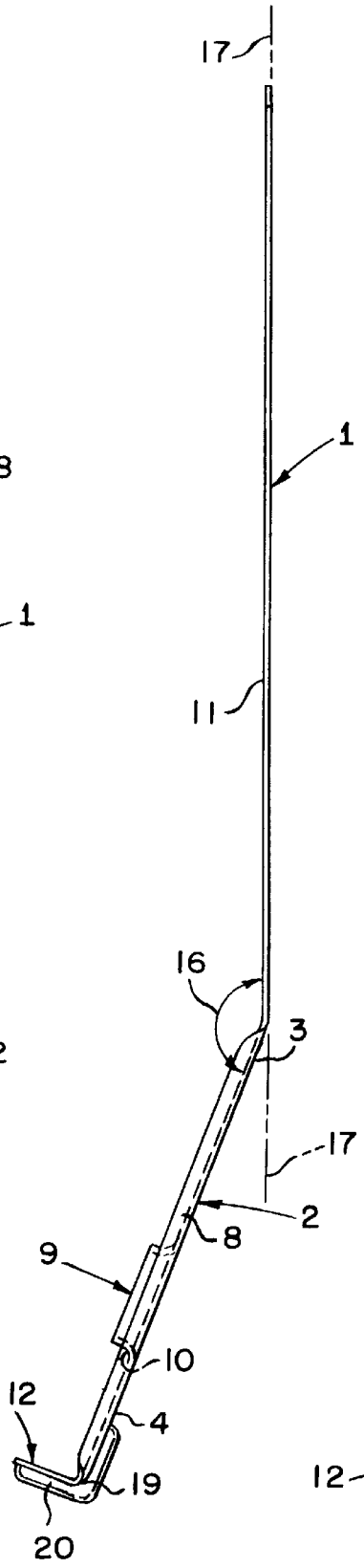
FIG. 2 is a side elevation view of the connector of FIG. 1 taken along line 2—2 of FIG. 1.
Figure 3:
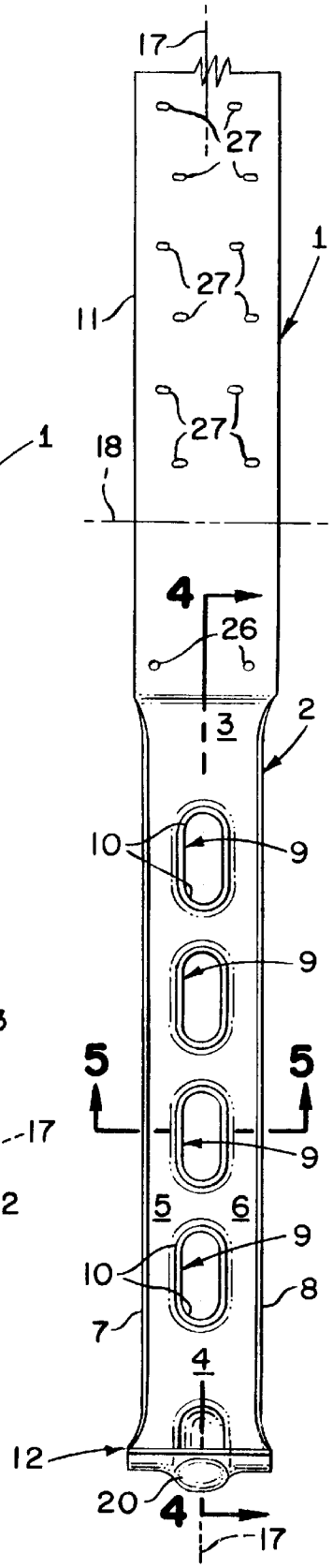
FIG. 3 is front elevation view of another form of a connector formed in accordance with the present invention. Only a portion of the attachment section of the connector is shown.

As seen in FIG. 2, the preferred embodiment of a connector 1 formed in accordance with the present invention has a hook section 12 that is dimensioned to present a wider cross section than the foot section 2. As seen in FIG. 1, the connector 1 has a longitudinal axis 17 and a lateral axis 18, and the hook section 12 is formed with a generally orthogonal lateral bend 19 for creating mechanical interlock with the concrete structural member 13. Also the hook section 12 is formed with a longitudinal embossment 20 that stiffens both the generally orthogonal lateral bend 19 and the hook section 12.

The preferred embodiment is formed from galvanized sheet metal. This permits the connector 1 to be made on standard, automated machinery common in the sheet metal connector industry. Furthermore, the preferred form requires no secondary production operations after it is formed such as welding or painting. This further reduces manufacturing costs.

FIG. 8, shows a typical use of the preferred embodiment. In FIG. 8 the first structural member 21 is a vertical stud of a framed wall 22 and the concrete structural member 13 is the foundation for the framed wall. Connectors formed in accordance with the present invention could also be used to tie joists to concrete walls to name one example. It should be noted that modifications can be made to a connector 1 formed in accordance with the present invention without departing from the scope of the invention. For example, U.S. Pat. No. 5,150,553, granted Sep. 29, 1992 to Commins teaches an attachment section that wraps around the first structural member 21.

Use and installation of a connector 1 having a foot section 2 of the preferred form to make a typical stem-wall-to-wooden-stud connection is best illustrated by FIG. 8. First, form boards for the concrete second structural member 13 or stem wall are set in place. The connector 1 is attached to the outer form board with fasteners. The attachment section 11 of the connector 1 is disposed vertically. The foot section 2 is disposed at a selected obtuse angle 16 from the attachment section that places the hook section 12 of the connector equidistant from the form boards. Preferably the connector is formed with fastener openings 26 for receiving the fasteners that temporarily attach it to the form board. Embedment indicia are also preferably included to aid the builder in attaching the connector 1 to the form board at the proper height. Concrete is then poured between the form boards to form the concrete structural member 13 having a side surface 14 and an upper surface 15. The curled side edges 7 and 8 of the foot section aid the flow of concrete around the foot section 2 of the connector 1 into the space between the foot section 2 and the side surface 14 of the concrete structural member 13 defined by the form board. The curled edges 10 of the drawn opening 9 serve a similar function. After the concrete has cured, the form boards are stripped away. A mudsill 23 is place on the upper surface 15 of the concrete structural member 13, with the outside edge 24 of the mudsill 23 in registration with a portion of the attachment section 11 of the connector 1. A first structural member 21 or vertical frame member is attached to the mudsill 23. A portion of the outside edge 25 of the first structural member 21 sits in registration with a portion of the attachment section 11 of the connector 1. Using fasteners, the attachment section 11 is attached to the first structural member 21. The attachment section 11 is shown having obround openings 27 for receiving fasteners for permanent attachment. The obround openings 27 allow the installer to angle or splay fasteners to minimize wood splitting and to compensate for misalignment of the connector 1 and the first structural member 21.

FIG. 8 shows the connector 1 anchoring a framed wall formed with a base that comprises only a mudsill 23. Use of the connector 1 formed in accordance with the present invention to anchor a framed wall 22 with a base that comprises a mudsill, a rim joist, a subfloor member, and a sole plate is similar to the installation described immediately above, and is thus not described separately.

The inventor has done extensive testing of connections and models of connections where the fist structural member 21 is a vertical frame member in a framed wall 22, the concrete structural member 13 is a 6" or 8" concrete stem wall, and the foot section 2 is disposed at a selected obtuse angle 16 to the attachment section. With such connections, whether the foot section 2 is to be embedded as shallowly as 8" or as deeply as 18" in the concrete structural member 13, the inventor has found that a connector 1 formed with curled side edges 7 and 8 and only one drawn opening 9 located near the distal portion 4 of the foot section 2 withstands tension loads best.

As an example, referring to FIG. 1, the following is a description of a connector 1 formed in accordance with the preferred form of the present invention that would be used to make a stem-wall-to-wooden-stud connection in a typical wood-framed building. The foot section 2 is formed with curled side edges 7 and 8 and one drawn opening 9 near the distal portion 4 of the foot section 2. The connector 1 is formed from 12 gauge galvanized sheet metal. It is approximately 3" wide. The foot section 2 and the hook section 12, together, are approximately 10" long. The longitudinal embossment 20 in the hook section 12 is approximately 1" wide by 2¾" long. The displaced portion of the hook section is 1½" long by 3" wide. The drawn opening is located approximately 3½" from the orthogonal lateral bend 19 in the hook section 12. The drawn opening 9 is formed as an obround slot that is approximately 2" long and 1" wide. The curled side edges 7 and 8 curl away from the lateral side portions 5 and 6 such that the width of the foot section is approximately 2⁷⁄₁₆". The attachment section is approximately 18⅛" long and 3" wide. The attachment section 11 is formed with 20 obround openings for receiving nailable fasteners to permanently attach the connector 1 to a first structural member 21. Two additional openings are added to the attachment section 11 near the proximal portion 3 of the foot section 2 for temporarily attaching the connector 1 to a form board. The connector 1 is formed with embedment indicia to aid the builder in attaching the connector 1 to the form board at the proper height, so that the fasteners enter the first structural member 21 at the best height. The foot section 2 is displaced from the plane of the attachment section 11 a selected obtuse angle 16 of 160 degrees.

Although a connector formed in accordance with the present invention has been described in detail, the above description is not intended to limit the scope of this invention except as stated in the claims.

I claim:

1. A connector for securing a first structural member to a concrete second structural member, said connector comprising:

a. a foot section having a proximal portion, a distal portion, substantially planar lateral side portions and curled lateral side edges, said curled side edges being curled away from said planar lateral side portions along a substantial portion of the length of said foot section to aid said concrete of said second structural member to flow around said foot section;

b. an attachment section integrally connected to said proximal portion of said foot section; and c. a hook section integrally connected to said distal portion of said foot section, said hook section adapted to provide mechanical interlock with said concrete of said second structural member.

2. The connector of claim 1, wherein:

said foot section is disposed at a selected obtuse angle to said attachment section.

3. The connector of claim 1, wherein:

said foot section is formed with a drawn opening therein.

4. The connector of claim 3, wherein:

said foot section is disposed at a selected obtuse angle to said attachment section.

5. The connector of claim 4, wherein:

said foot section is formed with only one drawn opening located near said distal portion of said foot section.

6. The connector of claim 2 or 5, wherein:

said hook section is dimensioned to present a wider cross section than said foot section.

7. The connector of claim 6, wherein:

a. said connector has a longitudinal axis and a lateral axis; and b. said hook section is formed with a generally orthogonal lateral bend.

8. The connector of claim 7, wherein:

said hook section is formed with a longitudinal embossment.

9. A connector for securing a structural member to a concrete second structural member, said connector comprising:

a. a foot section having a proximal portion, a distal portion and a drawn opening with curled edges, said curled edges of said drawn opening being curled to aid said concrete of said second structural member to flow around said foot section;

b. an attachment section integrally connected to said proximal portion of said foot section; and c. a hook section integrally connected to said distal portion of said foot section.

10. The connector of claim 9, wherein:

said foot section is disposed at a selected obtuse angle to said attachment section.

11. The connector of claim 10, wherein:

said hook section is dimensioned to present a wider cross section than said foot section.

12. The connector of claim 11, wherein:

a. said connector has a longitudinal axis and a lateral axis; and b. said hook section is formed with a generally orthogonal lateral bend.

13. The connector of claim 12, wherein:

said hook section is formed with a longitudinal embossment.

14. A connection between a first structural member and a concrete second structural member, said connection comprising:

a. said concrete second structural member;

b. a connector received by said concrete second structural member, said connector including, (1) a foot section, said foot section received by said concrete second structural member such that said connector is fixed relative to said concrete second structural member, said foot section having a proximal portion, a distal portion, substantially planar side portions and curled lateral side edges, said curled side edges being curled away from said planar lateral side portions along a substantial portion of the length of said foot section to aid said concrete of said second structural member to flow around said foot section, (2) an attachment section integrally connected to said proximal portion of said foot section, and (3) a hook section integrally connected to said distal portion of said foot section, said hook section forming a mechanical interlock with said concrete of said second structural member;

c. said first structural member located proximate a portion of said attachment section; and d. fastener means attaching said attachment section of said connector to said first structural member such that said connector is fixed relative to said first structural member.

15. The connection of claim 14, wherein:

said foot section is disposed at a selected obtuse angle to said attachment section.

16. The connection of claim 14, wherein:

said foot section is formed with a drawn opening therein.

17. The connection of claim 16, wherein:

said foot section is disposed at a selected obtuse angle to said attachment section.

18. The connection of claim 17, wherein:

said foot section is formed with only one drawn opening located near said distal portion of said foot section.

19. The connection of claim 15 or 18, wherein:

said hook section is dimensioned to present a wider cross section than said foot section.

20. The connection of claim 19, wherein:

a. said connector has a longitudinal axis and a lateral axis; and b. said hook section is formed with a generally orthogonal lateral bend.

21. The connector of claim 20, wherein:

said hook section is formed with a longitudinal embossment.

22. A connection between a first structural member and a concrete second structural member, said connection comprising:

a. said concrete second structural member;

b. a connector received by said concrete second structural member, said connector including, (1) a foot section, said foot section received by said concrete second structural member such that said connector is fixed relative to said concrete second structural member, said foot section having a proximal portion, a distal portion and a drawn opening with curled edges, said curled edges of said drawn opening being curled to aid said concrete of said second structural member to flow around said foot section, (2) an attachment section integrally connected to said proximal portion of said foot section, and (3) a hook section integrally connected to said distal portion of said foot section, said hook section forming a mechanical interlock with said concrete of said second structural member;

c. said first structural member located proximate a portion of said attachment section; and d. fastener means attaching said attachment section of said connector to said first structural member such that said connector is fixed relative to said first structural member.

23. The connection of claim 22, wherein:

said foot section is disposed at a selected obtuse angle to said attachment section.

24. The connection of claim 23, wherein:

said hook section is dimensioned to present a wider cross section than said foot section.

25. The connection of claim 24, wherein:

a. said connector has a longitudinal axis and a lateral axis; and b. said hook section is formed with a generally orthogonal lateral bend.

26. The connection of claim 25, wherein:

said hook section is formed with a longitudinal embossment.

27. A connection comprising:

a. a concrete foundation having a side surface and an upper surface;

b. a mudsill having an outside edge, an upper side and a lower side, said lower side resting on said upper surface of said concrete foundation;

c. a frame member having an outside edge and an end, said end resting on said upper side of said mudsill;

d. a connector including, (1) a foot section embedded in said concrete foundation, said foot section having a proximal portion, a distal portion, substantially planar lateral side portions and curled lateral side edges, said curled side edges being curled away from said planar lateral side portions along a substantial portion of the length of said foot section to aid said concrete of said foundation to flow around said foot section, and (2) an attachment section integrally connected to said proximal portion of said foot section and extending from said foot section, past said outside edge of said mudsill and along a portion of said outside edge of said frame member, and (3) a hook section integrally connected to said distal portion of said foot section, said hook section forming a mechanical interlock with said concrete of said foundation; and e. fastener means connecting said attachment section to said frame member.

28. The connection of claim 27, wherein:

a. said proximal portion of said foot section is located near said side surface and said upper surface of said concrete foundation; and b. said attachment section is formed with a bend at a selected angle near said proximal portion of said foot section.

29. The connection of claim 27 wherein:

said foot section is formed with a drawn opening therein.

30. The connection of claim 29, wherein:

a. said proximal portion of said foot section is located near said side surface and said upper surface of said concrete foundation; and b. said attachment section is formed with a bend at a selected angle near said proximal portion of said foot section.

31. The connection of claim 30, wherein:

said foot section is formed with only one drawn opening and it is located near said proximal portion of said foot section.

32. The connector of claim 28 or 31, wherein:

said hook section is dimensioned to present a wider cross section than said foot section.

33. The connector of claim 32, wherein:

a. said connector has a longitudinal axis and a lateral axis; and b. said hook section is formed with a generally orthogonal lateral bend.

34. The connection of claim 33, wherein:

said hook section is formed with a longitudinal embossment.

35. A connection comprising:

a. a concrete foundation having a side surface and an upper surface;

b. a mudsill having an outside edge, an upper side and a lower side, said lower side resting on said upper surface of said concrete foundation;

c. a frame member having an outside edge and an end, said end resting on said upper side of said mudsill;

d. a connector including, (1) a foot section embedded in said concrete foundation, said foot section having a proximal portion, a distal portion, and a drawn opening with curled edges, said curled edges of said drawn opening being curled to aid said concrete of said foundation to flow around said foot section, and (2) an attachment section integrally connected to said proximal portion of said foot section and extending from said foot section, past said outside edge of said mudsill and along a portion of said outside edge of said frame member, and (3) a hook section integrally connected to said distal portion of said foot section; and e. fastener means connecting said attachment section to said frame member.

36. The connector of claim 35, wherein:

said foot section is disposed at a selected obtuse angle to said attachment section.

37. The connector of claim 36, wherein:

said hook section is dimensioned to present a wider cross section than said foot section.

38. The connector of claim 37, wherein:

a. said connector has a longitudinal axis and a lateral axis; and b. said hook section is formed with a generally orthogonal lateral bend.

39. The connector of claim 38, wherein:

said hook section is formed with a longitudinal embossment.

* * * * *